United States Patent [19]

Janssen

[11] Patent Number: 4,607,443

[45] Date of Patent: Aug. 26, 1986

[54] VISIBLE INDEX POCKET CONSTRUCTIONS

[76] Inventor: Alexander P. Janssen, 28 Old Farm Rd., Charlottesville, Va. 22901

[21] Appl. No.: 570,383

[22] Filed: Jan. 13, 1984

[51] Int. Cl.[4] ..... B42F 5/00

[52] U.S. Cl. ..... 40/405; 40/360; 40/537

[58] Field of Search ..... 40/403, 360, 537, 405, 40/359

[56] References Cited

U.S. PATENT DOCUMENTS

| | | | |
|---|---|---|---|
| 2,232,193 | 2/1941 | Wassell | 40/405 |
| 2,370,074 | 2/1945 | Roscoe | 40/405 |
| 2,579,765 | 12/1951 | Skeels | 40/405 |
| 2,805,502 | 9/1957 | Smith et al. | 40/405 |
| 2,963,808 | 12/1960 | Guichard | 40/124.2 |
| 4,270,290 | 6/1981 | Eckert | 40/389 |
| 4,357,773 | 11/1982 | Dennis | 40/618 |

FOREIGN PATENT DOCUMENTS

| | | | |
|---|---|---|---|
| 2452251 | 4/1974 | Fed. Rep. of Germany | 40/124.2 |
| 685494 | 7/1930 | France | 40/405 |

*Primary Examiner*—Gene Mancene
*Assistant Examiner*—Wenceslad J. Contreras
*Attorney, Agent, or Firm*—Lowe, Price, LeBlanc Becker & Shur

[57] ABSTRACT

Visible index systems having hinged pockets to which cards or other information bearing components can be detachably affixed. A novel tip fixed to the main body of the pocket forms recesses into which information bearing components can be inserted to hold them against the faces of the main pocket component.

6 Claims, 6 Drawing Figures

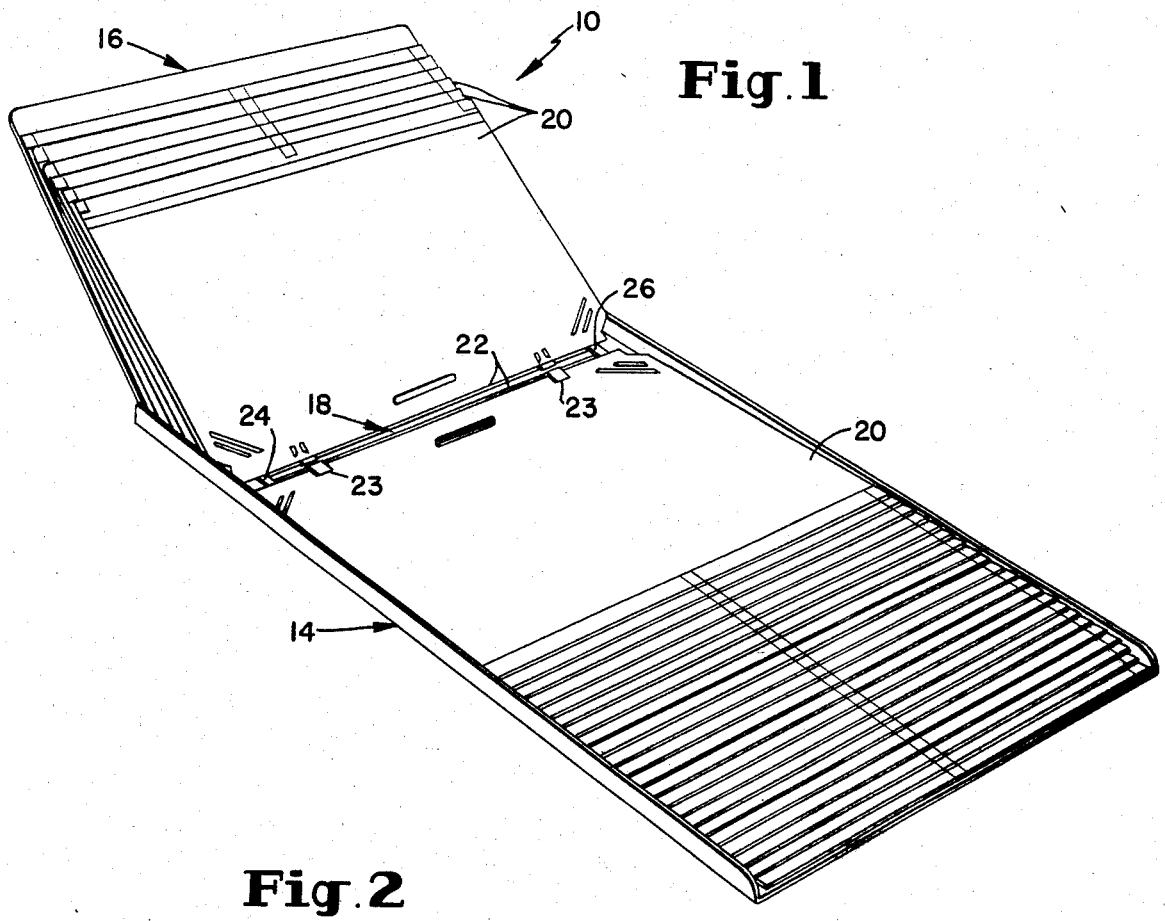
Fig. 1
Fig. 2
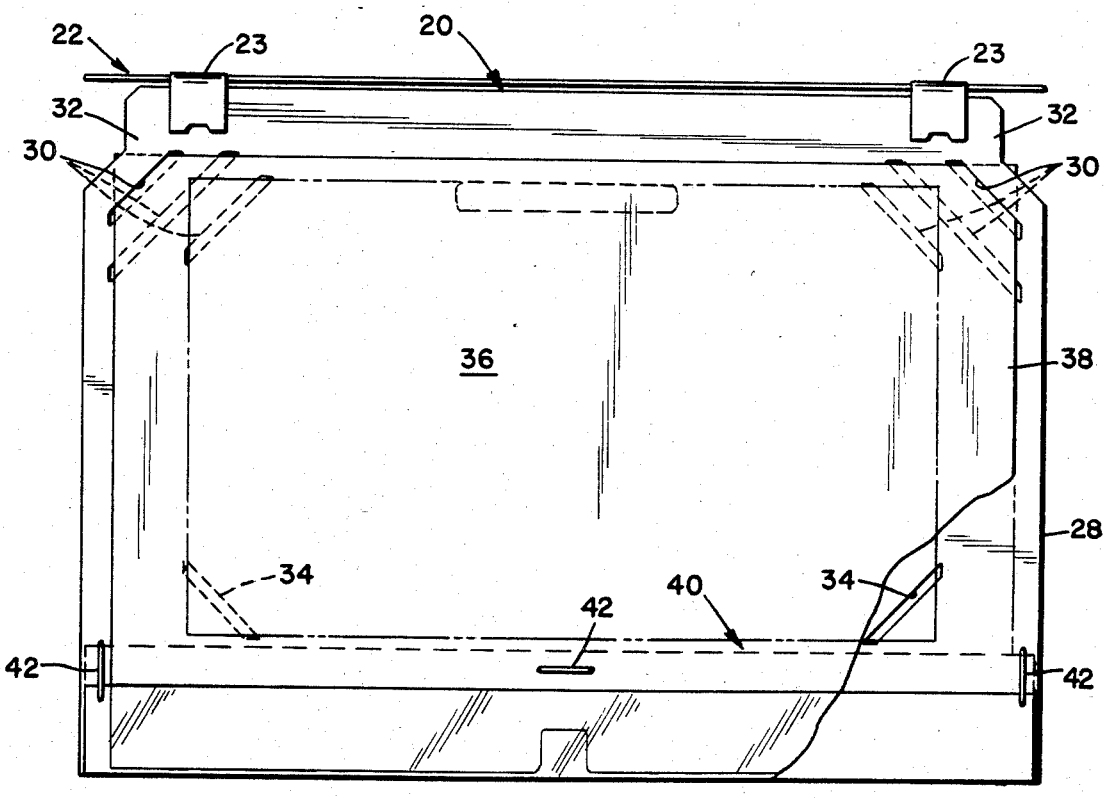

VISIBLE INDEX POCKET CONSTRUCTIONS

The present invention relates to visible index systems and, more particularly, to novel, improved visible index systems of the type in which pockets are employed to removably support data cards bearing information for ready access.

"Data card" is used herein in a special sense to generically identify all of those various forms and other sheet-type information bearing components which can be attached to visible index system pockets.

Visible index system pockets of the character I have invented and disclosed herein feature a novel pocket tip construction that gives those pockets a number of important advantages.

The pocket tip is used to affix one edge of the data card to the pocket. The novel tips I have invented and disclosed herein have the advantage that they so function on both sides of the pocket. As a consequence, the herein disclosed pockets are superior to those described in Datastrip Corporation publication No. 83-3-30 in terms of information density because the construction of the latter can accommodate data cards on only one side of the pocket unless the data cards are specially configured to accommodate the staples or other fasteners employed to attach the tip to the main body component of the pocket. This requires that the data cards be die cut. This is an extra and, therefore, cost increasing, manufacturing step. Furthermore, applicant has found that these specially configured pockets meet considerable user resistance because data cards obtained from one source may not be compatible with pockets obtained from another. Also, many printers do not have the equipment needed to die cut the data cards. In addition, the die cuts waste space which could otherwise be used to contain additional data.

Yet another advantage of the novel pockets disclosed herein is the versatility that is afforded in attaching the tip to the main body of the pocket. While a continuous seam formed as by heat sealing or ultrasonic bonding in the case of a plastic-to-plastic joint or a continuous glue line in the case of a plastic-to-paper or other non-plastic joint may give optimum strength, it is by no means required that continuous bonds be employed where economics or other considerations dictate otherwise. Spot-type bonds, staples, and other fasteners can equally well be employed to affix the tip to the main body of the pocket.

It will be apparent to the reader from the foregoing that one primary object of the present invention is the provision of novel, improved, data card supporting pockets for visible index systems.

A second primary and equally important object of the invention resides in the provision of pockets as described in the preceding object which have a novel data card supporting tip that gives the pocket a number of important qualities which typical, heretofore available visible index pockets do not have.

Other also important but more specific objects of my invention reside in the provision of visible index system pockets:

which allow geometrically simpler and, therefore, more easily manufactured and less expensive data cards to be used;

which allow data cards with greater customer acceptance to be used;

which accommodate cards with a greater information bearing capacity than typically configured, heretofore available cards of the same dimensions;

which are more durable than conventional index pockets because of a stronger attachment between the main body of the pocket and the pocket tip;

which allow a greater variety of techniques for attaching the pocket tip to the main body of the pocket to be employed.

Other important objects and features and additional advantages of my invention will be apparent to the reader from the foregoing and the appended claims and as the ensuing detailed description and discussion proceeds in conjunction with the accompanying drawing, in which:

FIG. 1 is a pictorial view of an exemplary tray type visible index unit; that unit includes pockets with tips embodying the principles of the present invention;

FIG. 2 is a plan view of one of the pockets shown in FIG. 1;

Figure 3:
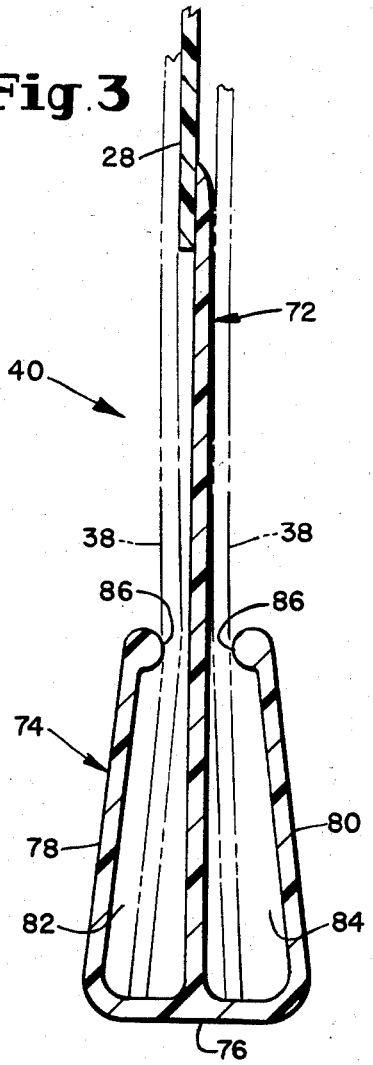
FIG. 3 is a cross section through the pocket tip and a thermoplastic main body.

Referring now to the drawing, FIG. 1 depicts a desk type visible index unit 10 of the type disclosed in my earlier issued Pat. No. 3,274,715 dated Sept. 27, 1966, and entitled RECORD FILING DEVICE. That unit includes a base 14, a cover 16, and a hanger wire plate 18.

Housed in the base 14 of unit 10 in overlapping relationship are pockets 20 which incorporate the principles of the present invention. Those pockets are detachably, and pivotably, secured in the base 14 of unit 10 by wires 22 extending through hinges 23 at the upper edge of the pocket and installed in channels 24 and 26 at opposite sides of base 14 (both "upper" and "lower" are arbitrary directions employed herein simply for the sake of convenience, are related strictly to FIGS. 2–6 of the drawing, and are not intended to impose any limitations upon the scope of the claims appended hereto).

As best shown in FIG. 2, each of the pockets 20 includes a main body member or component 28. That member has data card retaining slots 30 adjacent each of its upper corners 32. Diagonally oriented slots of similar character and identified by reference character 34 are formed adjacent the lower edge of each pocket 20.

Indicia or information bearing data cards 36 can be inserted into the slots 34 at the lower side of pocket 20 and into any of the corresponding slots 30 in the upper edge of the pocket on either side of the pocket to detachably secure the card to the pocket. Larger cards, identified by reference character 38 in FIG. 2, can, in accord with the present invention, be detachably secured to the pocket on both sides thereof by installing the lower edges of those cards in recesses formed in hereinafter to be described pocket tips 40 attached to the lower edge of the pocket opposite hinges 23, and by inserting the upper corners of the cards in appropriate ones of the upper slots 30.

Figure 6:
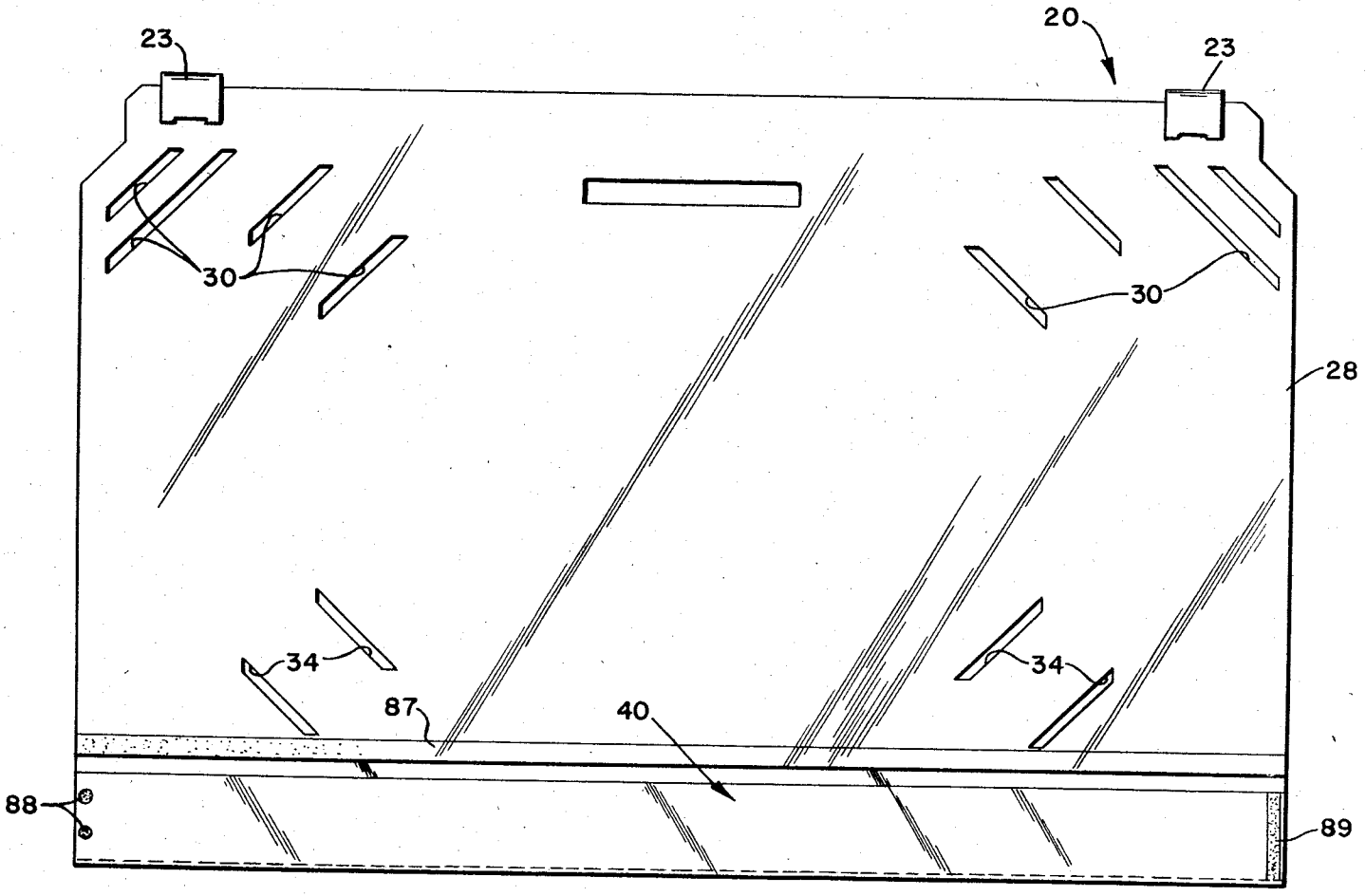
FIG. 6 is a view similar to FIG. 2 but showing an alternate method for attaching a tip to a main body member of a pocket.

The main body member of pocket 20 may be made of paper, a plastic such as polyvinylchloride (PVC), or other sheet type material. A preferred pocket tip 40, shown in cross section in FIGS. 3 and 4, will typically be extruded from an appropriate plastic such as PVC. The tip can be fixed to the main body of the pocket by an adhesive transfer tape such as 3M Corporation's No. 465; by staples 42 as shown in FIG. 2; or by a heat or ultrasonic spot or bar or bar seal, for example, if the main body member is a thermoplastic material. Other types of fasteners or an appropriate glue can be employed if that component is made of a material such as paper. Glue, heat, ultrasonic and other types of bonds can be of the spot type as shown in FIG. 6 or, alternatively, can extend the length of tip 40 and pocket main body member 28 as indicated in the same figure.

Referring now specifically to FIG. 3 of the drawing, pocket tip 40 has an elongated, upstanding stem 72 which is integrated with an outer member 74. The latter is of generally U-shaped configuration. It has a flat bottom 76 spanning upwardly extending side walls 78 and 80. Side walls 78 and 80 cooperate with protruding stem 72 to form recesses 82 and 84 into which the lower edges of data cards 38 can be inserted. Bulbous enlargements 86 at the upper, free edges of pocket tip side walls 78 and 80 facilitate the insertion of data cards 36 into recesses 82 and 84.

Figure 4:
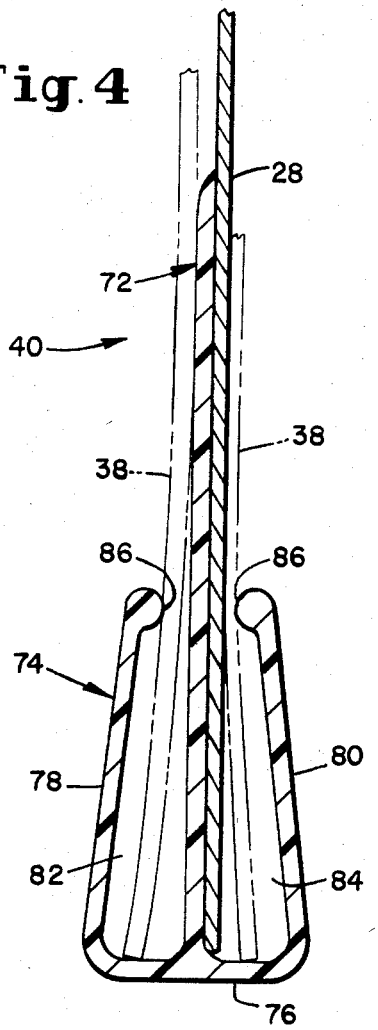
FIG. 4 is a cross section through a pocket tip as shown in FIG. 3 and a pocket main body of a material such as Kraft paper which is not thermoplastic.

The stem 72 of tip 70 can be secured to the main body component 28 of a pocket 20 by any of the several techniques discussed above. FIGS. 3 and 6, for example, show the tip joined to a thermoplastic main body member of the pocket by a seal 87 extending from edge to edge of the pocket and by spot seals 88 or bar seals 89 at those edges. FIGS. 2 and 4, on the other hand, show how the tip can be attached to the main pocket body member by staples 42. FIG. 2 also makes it apparent that rectangular cards can be installed in the tips without interference by the staples, an important, above-discussed advantage of the invention as it eliminates the need for data cards which are configured to avoid the staples if such cards are to be employed on both sides of the pockets.

The main body member 28 of the pocket can be dimensioned as shown in FIG. 3 or can extend to the bottom of the pocket as shown in FIG. 4.

Figure 5:
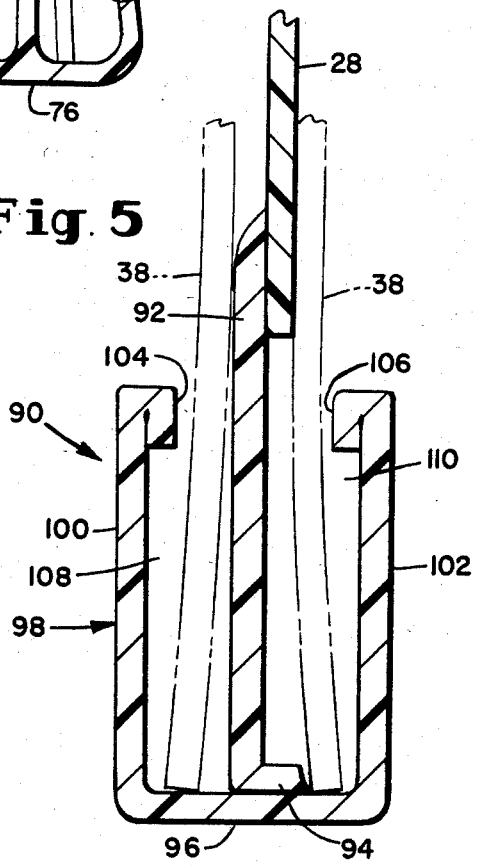
FIG. 5 is a view similar to FIG. 3 but showing a second form of pocket tip embodying the principles of my invention.

Referring still to the drawing, FIG. 5 depicts a pocket tip 90 which differs from the tip just discussed and illustrated in FIGS. 3 and 4 primarily in that it is of bipartite rather than unitary construction. That is, the stem 92 of pocket tip 90 is a separate member rather than an integral part of the tip as is the corresponding stem 72 of tip 40.

A ledge 94 is formed at the lower edge of stem 92. That ledge is sealed to the flat bottom 96 of pocket tip outer member 98 by any of the plastic-to-plastic techniques discussed above.

The outer pocket tip member 98 just identified spans upwardly extending side walls 100 and 102. Furthermore, the tip 90 shown in FIG. 5 has side walls which, at their upper or free edges, have inturned portions 104 and 106 that extend downwardly toward the bottom of the tip. These, again, facilitate the insertion of data cards 38 into the recesses 108 and 110 formed by the stem 92 and outer member side walls 100 and 102 of the tip.

As in the case of the tip 40 shown in FIGS. 3 and 4, the stem 92 of tip 90 protrudes beyond the sides 100 and 102 of outer member 98. This protruding stem portion is utilized to affix tip 90 to the associated paper, thermoplastic, or other main body component of the pocket by way of one of the techniques described above or in any other appropriate fashion.

The principles of the present invention have been described above primarily with respect to the type of pocket card shown in the drawing. It is to be understood that this was strictly for the sake of clarity and convenience and that those principles can equally well be employed in the manufacture of other pockets such as those of the bar or interlocking type. Pockets of that type are available from, for example, Kardex Systems, Inc., Green Street, Marietta, Ohio and Arnos Melbourne Pty Ltd, Napean Highway, Cheltenham, Victoria 3192, Australia.

Furthermore, the invention may be embodied in other specific forms without departing from the spirit or essential characteristics thereof. The present embodiment is therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by letters patent is:

1. A visible index pocket consisting essentially of:

a rectangular flexible planar sheet type member having first and seond pairs of substantially parallel opposed edges and having opposed faces for supporting data cards thereon, attaching means disposed at one of the first pair of said edges of said sheet type member for attaching said member to a supporting unit for substantially pivotal motion with respect to said unit, and a separate pocket tip attached and supported by the opposite edge of said first pair of edges of said sheet type member and extending substantially the length thereof, said second pair of edges being free of any attachment, said pocket tip comprising;

an elongated element having a central substantially planar stem and a pair of sides spaced from said stem on opposite sides thereof, said stem and said sides being attached together by a bottom extending outwardly in opposed directions from said stem to said sides, said stem and said sides extending in substantially the same direction from said bottom, said stem being attached to said second of said edges of said sheet type member to attach said pocket tip to said member, said sides and stem defining elongated substantially parallel recesses on opposite sides of said stem for receiving one edge of said data cards to thereby support said data cards on said opposed faces of said sheet type member with said data cards extending outwardly beyond said pocket tip across extended portions of said opposed faces of said sheet type member for support thereby and pivotal movement therewith.

2. A visible index pocket according to claim 1 wherein said stem extends from said bottom a greater distance than said sides extend from said bottom.

3. A visible index pocket according to claims 1 or 2 wherein the edges of said sides distal from said bottom are bulbous in shape.

4. A visible index pocket according to claims 1 or 2 wherein said stem, sides and bottom of said pocket tip constitute an integral unitary structure.

5. A visible index pocket according to claims 1 or 2 wherein the edges of said sides distal from said bottom are reversely bent toward said stem and extend back toward said bottom.

6. A visible index pocket according to claims 1 or 2 wherein said stem and said bottom constitute a two piece construction.

* * * * *